US007367776B2

(12) United States Patent
Albers et al.

(10) Patent No.: US 7,367,776 B2
(45) Date of Patent: May 6, 2008

(54) TURBINE ENGINE STATOR INCLUDING SHAPE MEMORY ALLOY AND CLEARANCE CONTROL METHOD

(75) Inventors: Robert Joseph Albers, Park Hills, KY (US); Rafael Ruiz, Liberty Township, OH (US); Marcia Boyle, Lebanon, OH (US); Christopher Charles Glynn, Hamilton, OH (US)

(73) Assignee: General Electric Company, Schnectady, NY (US)

( * ) Notice: Subject to any disclaimer, the term of this patent is extended or adjusted under 35 U.S.C. 154(b) by 63 days.

(21) Appl. No.: 11/043,369

(22) Filed: Jan. 26, 2005

(65) Prior Publication Data

US 2006/0165518 A1 Jul. 27, 2006

(51) Int. Cl.
*F01D 11/08* (2006.01)

(52) U.S. Cl. ..... 415/173.1; 415/173.6; 415/174.1; 415/174.2; 415/175

(58) Field of Classification Search ..... 415/173.1, 415/173.2, 173.4, 173.6, 174.1, 174.2, 174.4, 415/175, 173.3
See application file for complete search history.

(56) References Cited

U.S. PATENT DOCUMENTS 6,065,934 A 5/2000 Jacot et al.
6,135,713 A 10/2000 Domzalski et al.
6,220,550 B1 4/2001 McKillip, Jr.
6,318,070 B1 11/2001 Rey et al.
6,367,253 B2 4/2002 Kutlucinar
6,543,992 B2 * 4/2003 Webster ..... 415/173.1
7,052,017 B2 * 5/2006 Uchida et al. ..... 415/174.5

FOREIGN PATENT DOCUMENTS

GB 2354290 A 3/2001
JP 57195803 A * 12/1982
JP 58206807 A * 12/1983
JP 59018208 A * 1/1984

* cited by examiner

*Primary Examiner*—Igor Kershteyn
(74) *Attorney, Agent, or Firm*—Bryn T. Lorentz; William Scott Andres

(57) ABSTRACT

A turbine engine stator assembly in juxtaposition across a radial gap with a rotary blading assembly includes a radially movable shroud and a gap control member made of at least one shape memory alloy (SMA). The SMA is selected and preconditioned to deform pre-selected amounts to change the radial length of the gap during engine operation responsive to temperature about the SMA. A fluid flow means delivers fluid to the SMA at pre-selected temperatures during engine operation.

6 Claims, 3 Drawing Sheets

TURBINE ENGINE STATOR INCLUDING SHAPE MEMORY ALLOY AND CLEARANCE CONTROL METHOD

BACKGROUND OF THE INVENTION

This invention relates generally to turbine engine stator assemblies, and more particularly, to apparatus and method for controlling operating clearance between a stationary shroud surface in a turbine engine stator assembly and a rotating surface of juxtaposed blading members.

Forms of an axial flow turbine engine, typically a gas turbine engine, include rotating assemblies radially within stationary assemblies that assist in defining a flowpath of the engine. Examples include a rotary compressor assembly that compresses incoming air, and a rotary turbine assembly that extracts power from products of engine fuel combustion. Such assemblies comprise stages of rotating blades within a surrounding stator assembly that includes a shroud surface spaced apart from cooperating surfaces of the rotating blades. Efficiency of a turbine engine depends, at least in part, on the clearance or gap between the juxtaposed shroud surface and the rotating blades. If the clearance is excessive, undesirable leakage of engine flowpath fluid will occur between such gap resulting in reduced engine efficiency. If the clearance is too small, interference can occur between the rotating and stationary members of such assemblies, resulting in damage to one or more of such cooperating surfaces.

Complicating clearance problems in such apparatus is the well known fact that clearance between such turbine engine assemblies changes with engine operating conditions such as acceleration, deceleration, or other changing thermal or centrifugal force conditions experienced by the cooperating members during engine operation. Clearance control mechanisms for such assemblies, sometimes referred to as active clearance control systems, have included mechanical systems or systems based on thermal expansion and contraction characteristics of materials for the purpose of maintaining selected clearance conditions during engine operation. Such systems generally require use of substantial amounts of air for heating or cooling at the expense of such air otherwise being used in the engine operating cycle. Provision of an improved means for active clearance control that reduces the need for engine flowpath fluid for such heating or cooling could enhance engine efficiency.

BRIEF SUMMARY OF THE INVENTION

One form of the present invention comprises a turbine engine stator assembly circumferentially spaced apart about a turbine engine rotary blading assembly across a gap having a first radial gap length prior to engine operation. The stator assembly comprises a circumferential shroud having an inner shroud surface defining a first radial boundary of the gap and the rotary blading assembly comprises blading members having an outer blading member surface defining a second radial boundary of the gap. In such form, the stator assembly includes a shroud that is movable radially, at least one gap control member made of a shape memory alloy (SMA), and fluid flow means to deliver fluid, for example air, at pre-selected temperatures to the SMA of the gap control member. The SMA of the gap control member is selected and preconditioned to deform pre-selected amounts during engine operation, responsive to temperature of the fluid, to move the inner shroud surface radially in relation to the outer blading member surface to change the first radial gap length pre-selected amounts during turbine engine operation.

In another form, the present invention provides a method for varying the radial length of a gap between a circumferentially stationary surface, for example the shroud inner surface, and a circumferentially rotating surface, for example the outer blading member surface. A form of the method comprises the steps of providing means to enable the stationary surface to move radially. The first radial gap length is selected for use prior to engine operation and at least one additional radial gap length is selected for use during engine operation. Provided is a member made of a SMA operatively connected with the stationary surface. The SMA is selected, preconditioned and shaped to position the stationary surface and the rotating surface across a gap at the first radial gap length prior to engine operation and to deform pre-selected amounts during engine operation responsive to temperature about the SMA. Fluid flow means provides fluid at pre-selected temperatures to the SMA during engine operation to deform the SMA pre-selected amounts to move the stationary surface radially in relation to the rotating surface to the at least one additional radial gap length. For example, the SMA is preconditioned to position the shroud inner surface at the first radial gap length in regard to the outer blading member surface prior to engine operation, and preconditioned to position the shroud inner surface at the at least one additional radial gap length during engine operation responsive to the pre-selected temperature of the fluid.

DETAILED DESCRIPTION OF THE INVENTION

Figure 1:
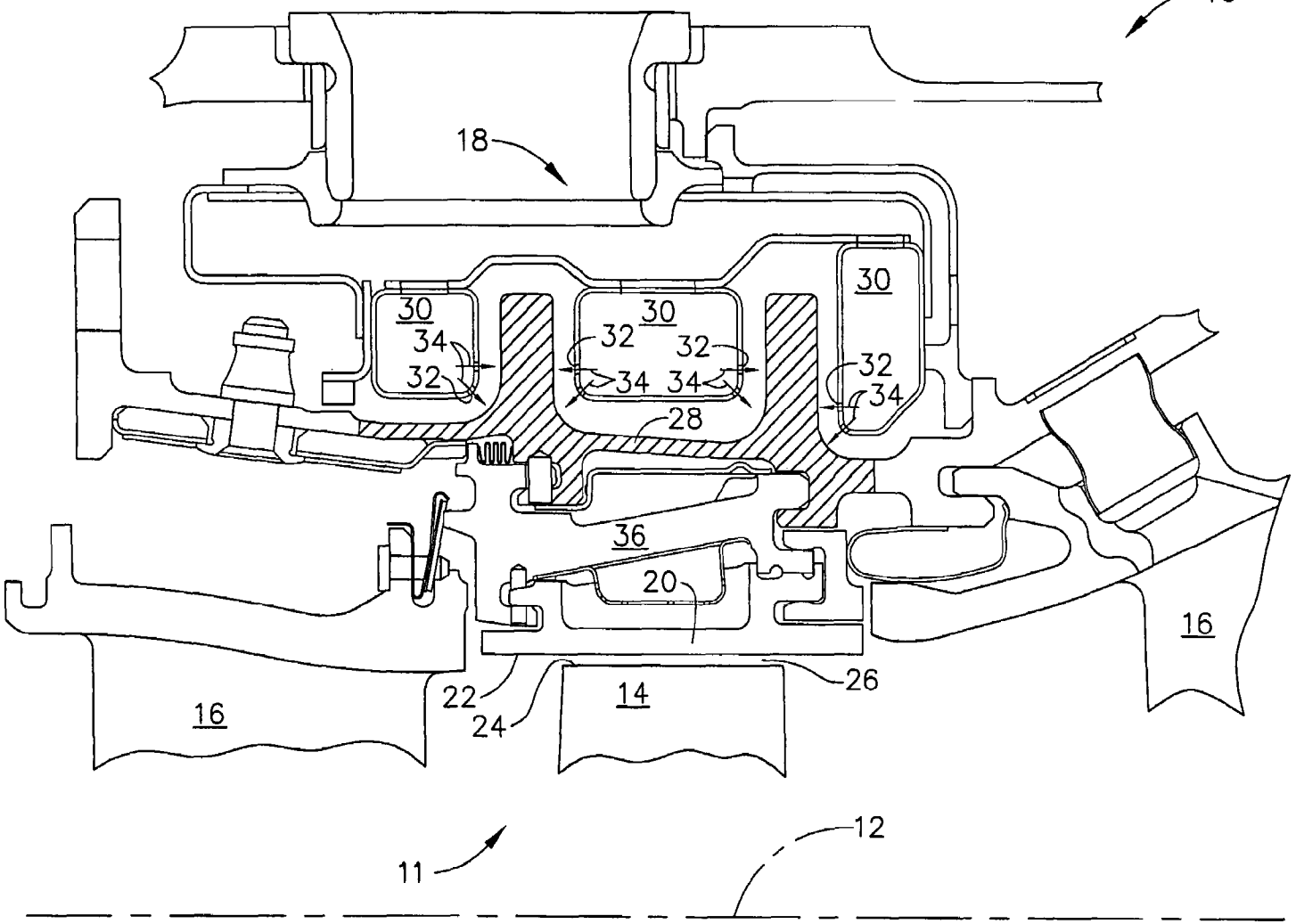
FIG. 1 is a diagrammatic, fragmentary, partially sectional view of a gas turbine engine turbine stator assembly about rotating turbine blades and including one embodiment of the SMA gap control member included in the stator assembly.

Several reported metal alloys that experience a temperature related solid state micro-structural phase change that enables an article made from such alloy to change from one physical shape to at least another physical shape sometimes are referred to as shape memory alloys (SMA). The temperature at which such phase change occurs generally is called the critical or transition temperature of the alloy. A widely known and reported SMA is a titanium nickel alloy frequently called Nitinol alloy. More recently reported higher temperature types of SMA are alloys of Ru alloyed with Nb or Ta to develop shape memory transition temperatures alleged to vary from room temperature up to about 1100° C. or about 1400° C., respectively. For specific uses, it has been reported that the transition temperature can be varied with modifications of composition.

In the manufacture from such an alloy of an article intended to change during operation from one shape to at least one other shape, the article is provided in a first shape intended for operating use at or above the transition temperature. Such first shape is developed by working and annealing an article preform of the alloy at or above the transition or critical temperature at which the solid state micro-structural phase change occurs. However, below that critical temperature, such an alloy is malleable and the article of the first shape can be deformed into a desired second shape, for example for inclusion at substantially room temperature in an assembly. Thereafter, for example in service operation of the article, when the SMA article in the second shape is heated at or above its critical temperature, it undergoes a micro-structural phase change that results in it returning to the first shape.

Typical of a large number of publications describing a SMA and identifying articles made of a SMA is U.S. Pat. No. 6,367,253—Kutlucinar relating to SMA actuators for aircraft landing gear. Such U.S. Pat. No. 6,065,934—Jacot et al.; U.S. Pat. No. 6,135,713—Domzalski et al; and U.S. Pat. No. 6,220,550B1—McKillip, Jr. describe use of a SMA in actuators related to helicopter rotor or tab controls. In addition, UK Patent Application publication GB 2,354,290 A—Care et al. describes use of a SMA as a flow control valve for cooling air in a gas turbine engine component.

According to forms of the present invention, a turbine engine stator assembly is provided with a combination of a circumferentially stationary shroud movable radially with respect to juxtaposed circumferentially rotating blading members across a gap therebetween, a gap control member made of a SMA to move the shroud radially responsive to temperature about the SMA, and fluid flow means to deliver fluid, for example air, at pre-selected temperatures to the SMA. The SMA of the gap control member is selected and preconditioned to deform pre-selected amounts during engine operation, responsive to temperature about the SMA. As used herein, phrases using the term "radial" or "radially" refer to general or predominant movement or positions in a turbine engine generally away from or toward the engine axis. Also, phrases using the term "axially" refer to positions generally along or in the direction of the engine axis; and phrases using the term "circumferential" or "circumferentially" refer to positions or directions generally circumferentially about the engine axis.

The present invention will be more fully understood by reference to the drawings in which FIG. 1 is a diagrammatic, fragmentary, partially sectional view of a turbine section of an axial flow gas turbine engine, shown generally at 10 and viewed circumferentially about engine axis 12. Turbine section 10 comprises a rotary blading assembly, shown generally at 11, of circumferentially rotating blading members such as rotating turbine blades 14 axially adjacent stationary turbine vanes 16. Included in turbine section 10 is a turbine stator assembly shown generally at 18 and including a circumferentially stationary turbine shroud 20, typically comprised of a plurality of circumferentially adjacent shroud segments for assembly circumferentially about turbine blades 14. Shroud 20 includes an inner surface 22 in juxtaposition with a blading member outer surface 24 respectively representing a first boundary and a second boundary of gap 26 between shroud inner surface 22 and blading member outer surface 24. As was discussed above, the radial length of gap 26 can affect efficiency of a turbine engine. Therefore, it is desired to maintain the radial length of gap 26 as small as possible during various engine operating conditions.

Included in stator assembly 18 is a gap control member 28, shown in cross section for emphasis in the drawings. Gap control member 28 in this embodiment is a circumferential ring-like member made of a SMA and secured within stator assembly 18 operatively connected with shroud 20. For example, gap control member 28 can be in direct contact with shroud 20 or, as shown in the drawings, in indirect contact with shroud 20 through one or more intermediate stator assembly members. Shroud 20 is movable radially responsive to movement of means such as members through which it is supported.

Cooperating with gap control member 28 is fluid flow means 30 to deliver fluid to gap control member 28, in one form about gap control member 28 as shown in the drawings. As an example, air at pre-selected and variable temperatures, can be delivered as a function of engine operating conditions. Associated with fluid flow means 30 can be a known type of fluid flow control (not shown) using known, pre-programmed fluid valves and valve controls, for selecting fluid, for example air, from and/or about other portions of the engine to selectively vary the temperature of fluid for the fluid flow means. For example for flexibility in varying fluid temperature, engine flowpath fluid, including air and/or products of combustion, as well as external, ambient air, can be selected as desired from various portions of a compressor and/or from ambient air for disposition through the fluid flow means. In the drawings, fluid flow means 30 is represented by generally circumferential air flow chambers or manifolds including openings 32 to deliver fluid 34, for example air from an, axially forward compressor (not shown), at the pre-selected temperatures about gap control member 28. The SMA of gap control member 28 is selected and preconditioned to deform pre-selected amounts during engine operation, responsive to the temperature of fluid 34. The temperature of fluid 34 can be varied by appropriate selection of the source of such fluid, for example stages of the compressor, ambient air, or their mixture.

According to embodiments of the present invention, shroud 20 is movable generally radially toward and away from turbine blade 14. Shroud 20 is moved as a result of force from gap control member 28 as it deforms selectively during engine service operation. In the embodiments of the drawings, such force is transmitted to shroud 20 through an intermediate member 36 of stator assembly 18. Such movement of shroud 20 moves shroud inner surface 22 toward or away from blading member outer surface 24 thereby changing the radial length of gap 26 and actively and selectively controlling the clearance between surfaces 22 and 24 to improve engine efficiency.

Figure 2:
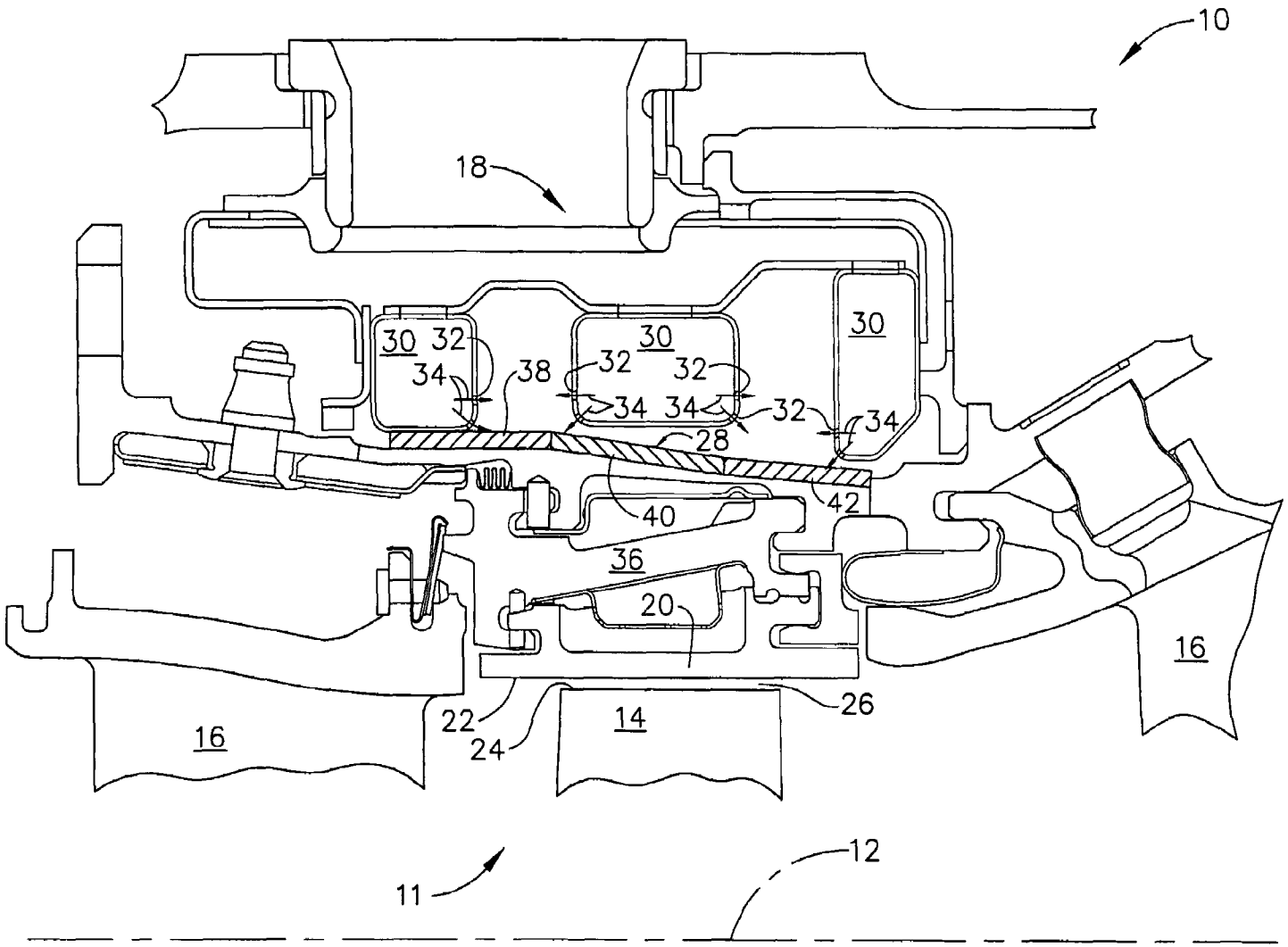
FIG. 2 is a diagrammatic view as in FIG. 1 including another embodiment of the SMA gap control member included in the stator assembly.
Figure 3:
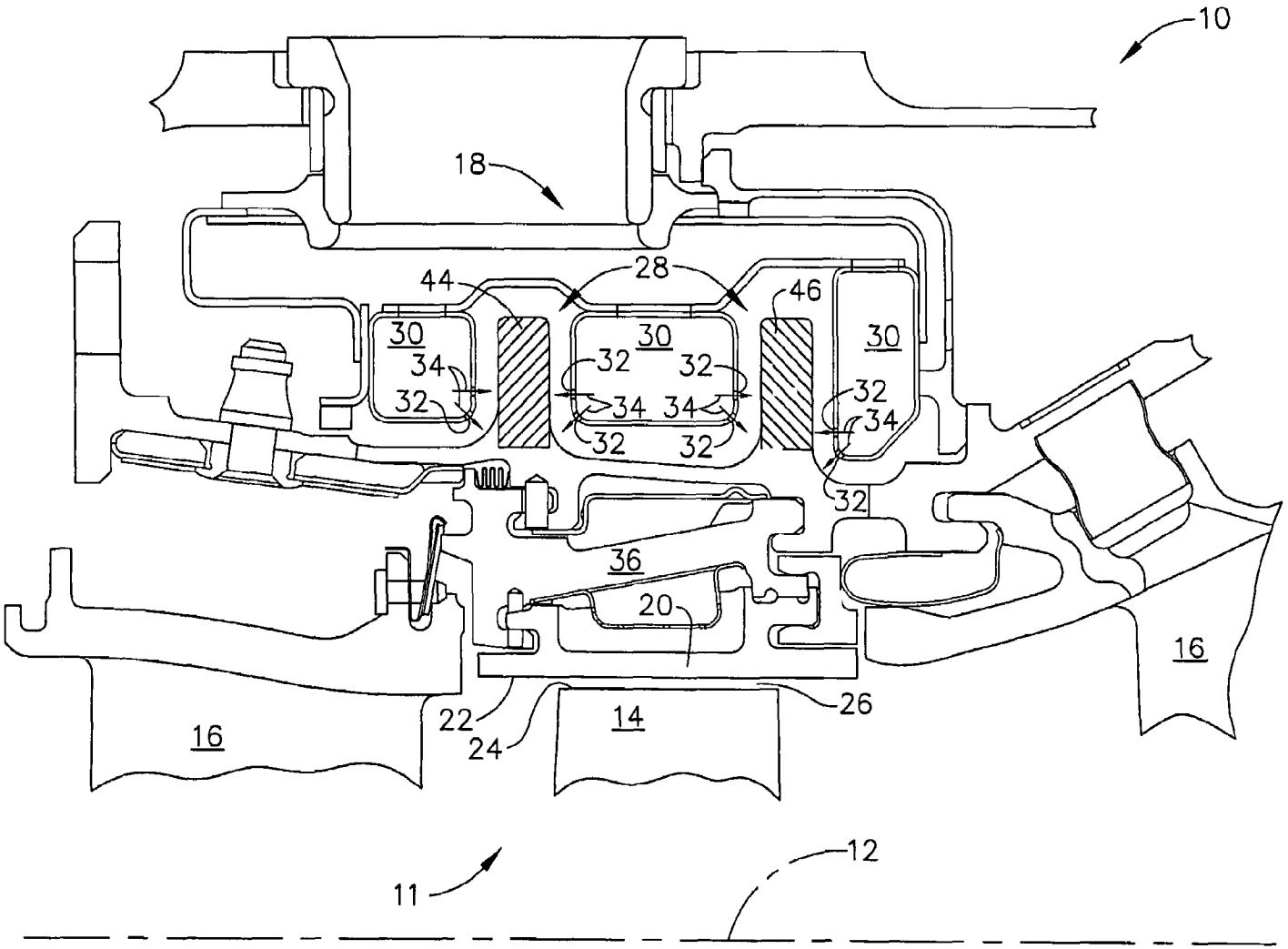
FIG. 3 is a diagrammatic view as in FIG. 1 including still another embodiment of the SMA member included in the stator assembly.

Another embodiment of gap control member 28 is shown in the diagrammatic, fragmentary, partially sectional view of FIG. 2. In that embodiment, gap control member shown in cross section generally at 28 comprises a plurality of circumferential, discrete portions 38, 40, and 42, generally in contact to define a substantially continuous, segmented gap control member. Still another embodiment of gap control member 28 is shown in the diagrammatic, fragmentary, partially sectional view of FIG. 3. Gap control member shown in cross section generally at 28 comprises a plurality of spaced-apart discrete circumferential rings 44 and 46. Each such discrete portion can be made of the same SMA or different SMA having thermal transition properties selected for enhanced control of gap 26 during various operating conditions of the engine.

Another form of the present invention provides a method for varying during engine operation the radial length of a gap, for example gap 26, between a circumferentially stationary surface, for example shroud inner surface 22, and a circumferentially rotating surface, for example blade outer surface 24. The method comprises providing means to enable stationary surface 22 to move radially. A first radial gap length is selected for use prior to engine operation and at least one additional radial gap length is selected for various operating conditions during engine operation. Gap control member 28 made of a SMA is provided operatively connected with stationary surface 22. The SMA is selected, preconditioned and shaped to position stationary surface 22 and rotating surface 24 across gap 26 at the first radial gap length prior to engine operation and to deform pre-selected amounts during engine operation responsive to temperature about the SMA. Fluid flow means 30 is provided to deliver fluid 34 at pre-selected temperatures to the SMA of gap control member 28.

The present invention has been provided to enable a turbine engine stator assembly to change, during various engine operating conditions, a radial gap length between a surface of a static shroud and a juxtaposed surface of a rotating blading member. Although the present invention has been described in connection with specific examples, materials and combinations of structures and shapes, it will be understood that they are intended to be typical of rather than in any way limiting on the scope of the present invention. Those skilled in the various arts involved, for example relating to design and operation of turbine engines, to the use and structure of SMA materials, etc., will understand that the invention is capable of variations and modifications without departing from the scope of the appended claims.

What is claimed is:

1. A turbine engine stator assembly circumferentially spaced apart about a turbine engine rotary blading assembly across a gap having a first radial gap length prior to turbine engine operation, the stator assembly comprising a circumferential shroud having a shroud inner surface defining a first radial boundary of the gap, and the rotary blading assembly comprising blading members having a blading member outer surface defining a second radial boundary of the gap, wherein:

the circumferential shroud is movable radially;

the stator assembly includes at least one gap control member having a plurality of discrete shape memory ally (SMA) portions comprising at least two different SMA in combination with fluid flow means to deliver fluid at pre-selected temperatures to the SMA portions of the gap control member;

the SMA of the gap control member are selected and preconditioned to deform pre-selected amounts during engine operation, responsive to temperature of the fluid, to move the circumferential shroud and the shroud inner surface radially in relation to the blading member outer surface to change the first radial gap length pre-selected amounts during engine operation.

2. The stator assembly of claim 1 in which the fluid flow means delivers fluid about the SMA.

3. The stator assembly of claim 1 in which the fluid flow means includes a flow control for selectively varying the temperature of the fluid during engine operation.

4. In a turbine engine, a method for varying a radial length of a gap between a circumferentially stationary surface and a circumferentially rotating surface, the method consisting of:

providing means to enable the stationary surface to move radially;

selecting a first radial gap length for use prior to engine operation;

selecting at least one additional radial gap length for use during engine operation;

providing a gap control member made of a SMA operatively connected with the stationary surface, the SMA being selected, preconditioned and shaped to position the stationary surface and the rotating surface across the gap at the first radial length prior to engine operation and to deform pre-selected amounts during engine operation, responsive to temperature about the SMA; and, providing fluid flow means to deliver fluid at pre-selected temperatures to the SMA during engine operation to deform pre-selected amounts to move the stationary surface radially in relation to the rotating surface to the at least one additional radial gap length.

5. The method of claim 4 in which:

the stationary surface is an inner surface of a shroud; and, the rotating surface is an outer surface of a blading member.

6. The method of claim 4 in which the fluid flow means delivers the fluid about the SMA.

* * * * *